United States Patent [19]

Pepper

[11] Patent Number: 4,569,256

[45] Date of Patent: Feb. 11, 1986

[54] METHOD OF MAKING A SEAMLESS PUNCH

[76] Inventor: Edward Pepper, 8822 Baywood Dr., Huntington Beach, Calif. 92646

[21] Appl. No.: 649,432

[22] Filed: Sep. 11, 1984

[51] Int. Cl.[4] ..... B26F 1/14

[52] U.S. Cl. ..... 76/107 C; 72/370; 76/101 R; 83/684

[58] Field of Search ..... 76/101 D, 101 R, 107 C, 76/107 R; 72/370, 398, 471; 83/684

[56] References Cited

U.S. PATENT DOCUMENTS

| | | | |
|---|---|---|---|
| 1,828,915 | 10/1931 | Wentworth | 83/164 |
| 1,837,524 | 12/1931 | Braden | 76/107 C |
| 2,455,538 | 12/1948 | Wagner | 76/107 R |
| 3,403,543 | 10/1968 | Gregory | 72/398 |
| 4,494,426 | 1/1985 | Hartzell | 83/164 |
| 4,513,601 | 4/1985 | Herbulot | 72/398 |

*Primary Examiner*—James M. Meister

*Attorney, Agent, or Firm*—Knobbe, Martens, Olson & Bear

[57] ABSTRACT

A device for punching holes in paper cards is disclosed and a process for fabricating the device. The hole punching device is formed to be a seamless member which may be shaped to conform to any of a variety of shapes and of various lengths. The device is formed by deforming a length of tubing to conform to the shape of a core die and one or more depressions in the pressurizing surfaces.

6 Claims, 9 Drawing Figures

Fig. 1
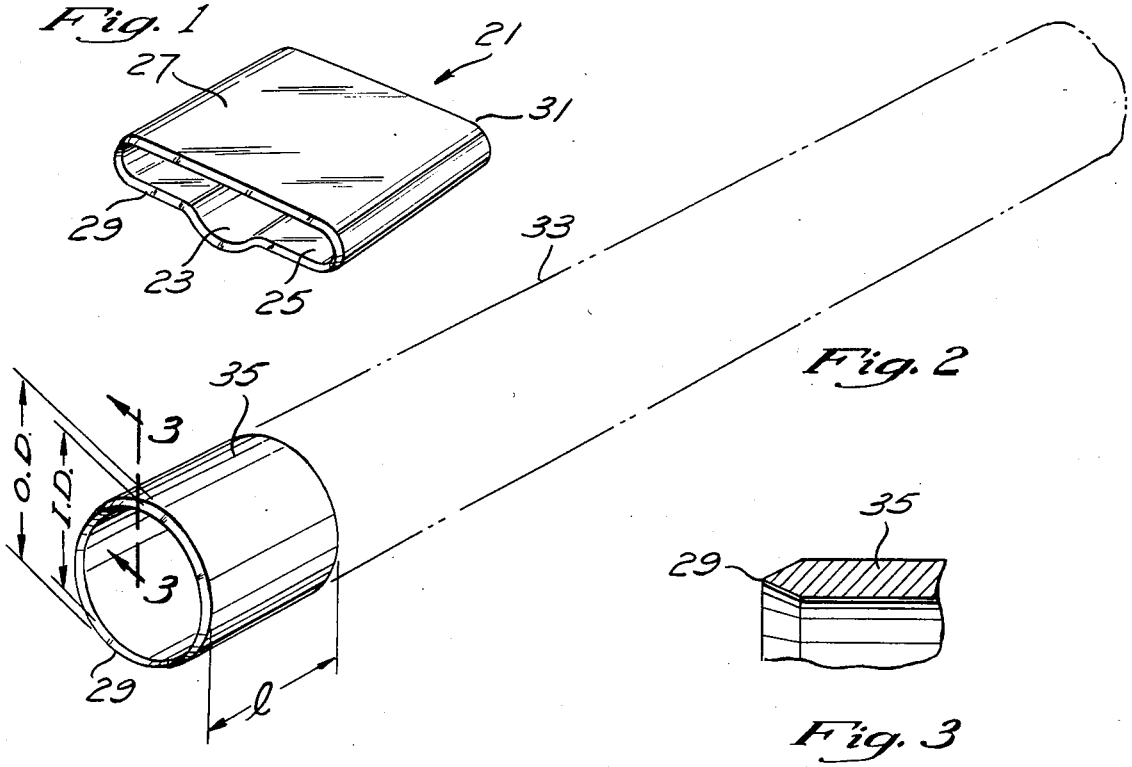
Fig. 2
Fig. 3
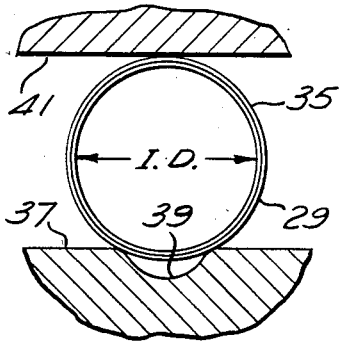
Fig. 4
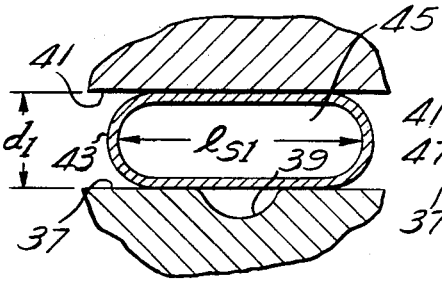
Fig. 5
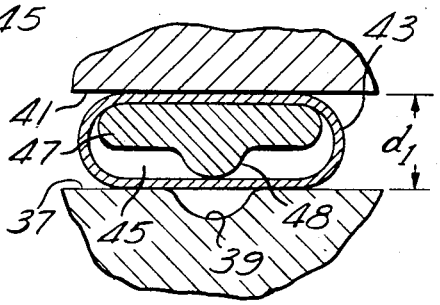
Fig. 6
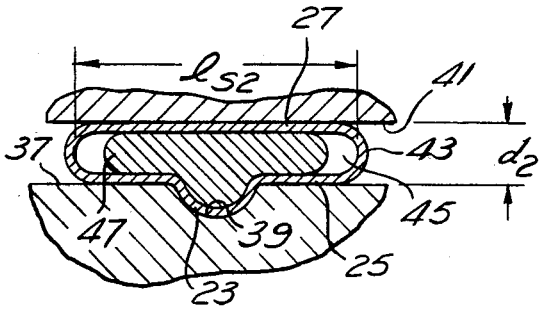
Fig. 7
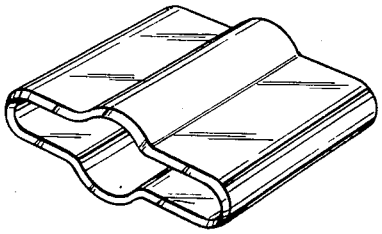
Fig. 8
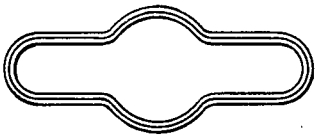
Fig. 9

METHOD OF MAKING A SEAMLESS PUNCH

BACKGROUND OF THE INVENTION

The present invention relates to devices for punching holes in materials such as paper cards, rubber or leather products. More particularly, the invention relates to a seamless hole puncher and a method for making the same.

Various types of hole punchers have been used in order to punch holes in products. Hole punchers may be used to cut regular shaped holes, e.g. round holes or to cut irregular shaped holes that will allow the product to engage various types of extensions, e.g. round pegs or flat extensions, from which the products are hung. Typical of those products are blister packs, formed by mounting a product to be sold on a paper card and covering the product with a clear plastic coating which secures the product to the card.

Contemporary hole punchers are typically seamless, formed by machining a cutting lip onto a solid mass of metal or formed by bending and welding a length of flat metal to form a seam along the length of the hole puncher. Previous seamless hole punches have been limited to round or oblong punches formed of relatively thick tubing, e.g. approximately 0.062 and 0.049 inches wall thickness. Though such punchers are satisfactory for forming round or oblong shaped holes, the thickness of such punchers and the technique by which they are formed do not lend themselves to the formation of more irregularly shaped hole punchers which can produce holes having greater practical or aesthetic appeal.

Machined hole punches are also typically confined to use in the formation of regular shaped holes. The machinery, skilled labor and attendant expense associated with this method of fabricating hole punches are the principal limiting factors in restricting its commercial application.

Punches that cut holes having irregular shapes, such as holes that will accommodate round and flat extensions, have previously been made by bending ruled steel strips and welding the ends together. That process is complicated and produces a product inferior to the seamless hole punch. There are also a number of other economic aspects of the contemporary bending process which limit the commercial usefulness of that process. For example, the bending process requires expensive bending machinery, which must be carefully set up by skilled labor. Furthermore, the difficulties associated with the production of taller punches, under the conventional bending process, increase with the height of the punch. That increase is due to the difficulty in closely aligning edges of the punch produced by the bending process. That difficulty effectively limits the height of a punch that can be economically produced by the conventional bending process. Such tall punches are useful, for example, in punching holes in paper cards having a raised packaging portion attached to the card, e.g. blister packs.

Accordingly, there is a need to provide a hole puncher and an process for forming a hole punch an apparatus for punching holes which more readily lends itself to mass production techniques to produce hole punchers of various sizes. Furthermore, there is a need for high quality hole punchers which can be produced without the need for highly skilled labor or expensive bending machinery.

SUMMARY OF THE INVENTION

Accordingly, a seamless hole puncher and a process for fabricating the same are provided which enable economical construction of a high quality seamless hole puncher of various shapes. The hole puncher is produced by cutting a cutting edge onto a circular thin walled tube. The tube is then softened and partially flattened to allow the insertion of a core into the tube. The tube is then flattened further under pressure such that the surface of the tube conforms to the shape of the core and the core receiving depression in at least one of the pressurizing surfaces. The tube may then be hardened to the desired level.

BRIEF DESCRIPTION OF THE DRAWINGS

FIG. 1 is a perspective view of an exemplary hole puncher produced in accordance with the present invention.

FIG. 2 is a perspective sectional view of a length of tube that may be used to form the hole puncher.

FIG. 3 is an enlarged sectional view of the tube shown in FIG. 2, illustrating the cutting edge formed about the circumference of the tube.

FIG. 4 is a front view of a length of round tube disposed between pressurizing surfaces.

FIG. 5 is a front view of a length of the tube shown at FIG. 5 after having been partially flattened.

FIG. 6 is a front view of the arrangement shown in FIG. 5 wherein a core die is disposed within the tube.

FIG. 7 is a front view of the assembly illustrated at FIG. 6, after having been further flattened and deformed to conform to the shape of the core and the depression in one of the pressurizing surfaces.

FIG. 8 is a perspective view of an alternative seamless hole punch formed in conformance with the present invention wherein both the upper and lower surfaces of the hole punch have been deformed.

FIG. 9 is a front view of the hole punch illustrated at FIG. 8.

DETAILED DESCRIPTION OF THE PREFERRED EMBODIMENT

FIG. 1 illustrates a perspective view of a seamless hole puncher that may be fabricated in accordance with the present invention. Seamless punch 21 is formed to have a generally oblong shape with a deformation 23 in the lower surface 25. Upper surface 27 is flat and seamless. By comparison, hole punchers formed by the bending and welding process typically have a welded seam extending the height of the hole puncher in the center of surface 27. The present invention eliminates the necessity for such a seam along with the expense and quality control problems attendant thereto. The front edge 29 of the hole puncher is provided with a cutting a cutting edge to penetrate the material to be cut, such as paper, leather or rubber products. The rear edge 31 of the hole puncher is typically flat.

The formation of the hole puncher illustrated at FIG. 1 is illustrated at FIGS. 2–7 and is as follows. The fabrication process typically begins with a length of thin, walled, circular tubing 33, as illustrated at FIG. 2. Preferably, the tubing has a wall thickness in the range of 0.028–0.042 inches. The round tube 33 is cut at any desired length, 1, to form tube section 35 having an inside diameter I.D. and an outside diameter O.D.

Tube 33 may be formed of various types of materials depending upon the particular application for the hole puncher. In the presently preferred embodiment, tube 33 is formed of 1018 machine steel. In general, the material should be soft enough to be deformable to conform to the shape defined by the core die and the opposing pressurizing surface. Further hardening, if necessary, can be achieved by case hardening a finished product to the desired level.

As shown at FIG. 3, a cutting edge 29 is formed in the front edge of tube section 35. Cutting edge 29 may be formed before section 35 is separated from the remainder of tube 33, or may be formed after section 35 has been separated from tube 33. Apparatus and processes for cutting an edge onto the end of tube section 35 are well known in the art.

After tube section 35 is separated from the remainder of tube 33, it is preferably softened to facilitate the deformity of the tube section into the desired shape of the hole puncher. In the presently preferred embodiment, that softening is accomplished by heating the tube section 35 to a temperature of approximately 1550° F. in a salt bath. The tube section is then cooled slowly in room air. Other processes may be alternatively implemented to soften the material for deformity within the scope of the present invention. Advantageously, a group of tube sections can be softened at one time.

In order to deform tube section 35 into the desired shape, such as illustrated at FIG. 1, the tube section is placed upon a supporting die 37, as illustrated at FIG. 4. Die 37 includes depression 39, above which tube section 35 is disposed. Surface depression 39 is shaped to conform to the desired shape of hole punch depression 23, as shown in FIG. 1.

Surface 41 is disposed in space opposed relation to surface 37 and is parallel to surface 37. Surfaces 37 and 41 are pressurizing surfaces, adapted for relative movement so as to bring surface 41 into contact with the top of tube section 35 and flatten the tube section.

As shown at FIG. 5, surfaces 37 and 41 may be brought closer together to a separation distance, $d_1$, which is substantially less than the outside diameter, O.D., of tube section 35. That action causes tube section 35 to be deformed into an oblong shaped member 43, having a height equal to the separation distance $d_1$, the space between surfaces 41 and 37. The oblong tube member 43 also has an inner cavity or slot 45, having a length, $l_{s1}$, which is greater than the inside diameter, ID, of tube section 35. Thus, as tube section 35 is flattened the length of the inner cavity 45 increases.

In order to deform the oblong shaped tube member 43 to the desired shape a die core 47 is fitted within the slot 45. The die core 47 is typically sized such that it snugly fits within the slot 45 when the surfaces 37 and 41 are separated at a distance, $d_1$. Die core 47 may be formed of various materials, such as low or high carbon steel.

The die core 47 includes dome portion 48 which is shaped so as to be receivable within depression 39. Thus, depression 39 and core die 47 should be constructed to engage each other, with allowances for the thickness of the oblong shaped member that is disposed therebetween.

FIG. 7 illustrates the deformation of the oblong shaped member within depression 39. As surfaces 41 and 37 are brought towards each other to a separation distance, $d_2$. The tube section is further flattened and the length of the slot 45, within oblong tube member 43 expands to a length of $l_{s2}$. Under the compressive forces applied to oblong shaped member 43 by surfaces 37 and 41, a portion of the lower surface of the oblong member 43 adjacent the dome 48 of core die 47, is deformed to contour to the shape of the space between dome 48 and the depression 39. After the deformity is created the core die 47 may be withdrawn from the slot 45 for reuse. Further hardening may be accomplished by technique such as case hardening.

In the presently preferred embodiment the hole punch is hardened after formation by heating to approximately 1550° F. at which temperature the tube member is maintained for approximately eleven minutes, and then the hole punch is quenched in oil. Such hardening of 1018 machine steel formed to a hole punch by the above-described process produces a hole punch having a hardness of approximately 52 to 58 RC (Rockwell"C" scale). The punch may be hardened further if desired. Other alternative methods of hardening may, of course, be employed within the scope of the present invention. Conveniently, a quantity of punches may be hardened at one time.

As would also be apparent to those of ordinary skill in the art, the core die 47 and the depression 39 in surface 37 may be formed to define a variety of different shapes. Similarly, depressions may be provided in both surface 37 and surface 41, with core die 47 being constructed to have domes or other types of protrusions on both its upper and lower surfaces, to deform the oblong tube member on both the upper and lower surfaces. An exemplary hole punch having deformations formed in both the upper and lower surfaces are shown at FIGS. 8 and 9.

Other alternative shapes and variations of the fabricating process may also be implemented without departing from the spirit or scope of the present invention which is intended to be limited only by the appended claims.

I claim:

1. A process for fabricating a hole puncher comprising:

cutting a cutting edge on one end of a length of tubing;

softening the tubing to permit deformation under applied pressure;

partially flattening the tubing by squeezing the tubing between opposing surfaces;

inserting a core within the tubing, said core defining at least a portion of the desired shape of the hole puncher;

squeezing the tubing against said core to cause at least a portion of said tubing to conform to the shape of said core and hardening said tubing.

2. The process as recited in claim 1 wherein the step of softening the tubing comprises the step of annealing the tubing to render the tubing less brittle during fabrication.

3. The process as recited in claim 1 wherein the step of softening the tubing comprises the step of heating the tubing to approximately 1550° F. in a salt bath and slowly cooling the tubing in room air.

4. The process as recited in claim 1 wherein the step of hardening the tubing comprises the step of case hardening the tubing.

5. The process as recited in claim 1 wherein the step of hardening the tubing comprises the steps of heating the tubing to approximately 1550° F., maintaining the tubing at approximately 1550° F. for approximately eleven minutes, and quenching the tubing in oil.

6. The process as recited in claim 1 wherein the step of squeezing the tubing against said core comprises the steps of forming a depression in the surface in at least one of said opposing surfaces, said depression being adapted to receive a portion of said core, and squeezing at least one of said opposing surfaces against said core so as to deform an inside portion of said tubing to form the shape of said portion of said core and an outside portion of said tubing to form the shape of said surface depression.

* * * * *